US010195847B2

(12) United States Patent
Hatta

(10) Patent No.: US 10,195,847 B2
(45) Date of Patent: Feb. 5, 2019

(54) LIQUID JETTING APPARATUS

(71) Applicant: BROTHER KOGYO KABUSHIKI KAISHA, Nagoya-shi, Aichi-ken (JP)

(72) Inventor: Fumika Hatta, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/935,799

(22) Filed: Mar. 26, 2018

(65) Prior Publication Data

US 2018/0281387 A1 Oct. 4, 2018

(30) Foreign Application Priority Data

Mar. 31, 2017 (JP) ..... 2017-072999

(51) Int. Cl.
*B41J 29/38* (2006.01)
*B41J 2/045* (2006.01)

(52) U.S. Cl.
CPC ..... *B41J 2/0457* (2013.01); *B41J 2/04508* (2013.01); *B41J 2/04581* (2013.01)

(58) Field of Classification Search
CPC .. B41J 2/0457; B41J 2/04508; B41J 2/04581; B41J 29/38
USPC ..... 347/5, 9–11, 14, 19
See application file for complete search history.

(56) References Cited

U.S. PATENT DOCUMENTS 6,296,341 B1 * 10/2001 Sugahara ..... B41J 2/04573 347/11
6,386,674 B1 5/2002 Corrigan, III et al.
8,220,892 B2 * 7/2012 Naoi ..... B41J 29/38 347/10
9,061,492 B2 * 6/2015 Watanabe ..... B41J 2/04588
(Continued)

FOREIGN PATENT DOCUMENTS

EP 0 899 102 A2 3/1999
JP 2009-148945 A 7/2009
JP 2013-154595 A 8/2013
(Continued)

OTHER PUBLICATIONS

Partial European Search Report issued in related European Patent Application No. 18164386.7, dated Aug. 6, 2018.
(Continued)

*Primary Examiner* — An Do
(74) *Attorney, Agent, or Firm* — Merchant & Gould P.C.

(57) ABSTRACT

A liquid jetting apparatus includes: a head including nozzles and driving elements arranged to correspond to the nozzles; a power source connected to the driving elements; and a control circuit connected to the power source. The control circuit determines whether an output voltage value of the power source is changed from a first voltage value to a second voltage value. When the control circuit has determined that the output voltage value is changed from the first voltage value to the second voltage value, the control circuit calculates an absolute value of a difference between the first voltage value and the second voltage value and compares the
(Continued)

absolute value of the difference and a threshold value. When the absolute value of the difference is equal to or more than the threshold value, the control circuit determines a calculation voltage value smaller than the absolute value of the difference.

23 Claims, 15 Drawing Sheets

(56) References Cited

U.S. PATENT DOCUMENTS

| | | | | |
|---|---|---|---|---|
| 2007/0109344 | A1 | 5/2007 | Kojima | |
| 2017/0282547 | A1 * | 10/2017 | Hatta | B41J 2/04581 |

FOREIGN PATENT DOCUMENTS

| | | | |
|---|---|---|---|
| JP | 2015-168195 | A | 9/2015 |
| JP | 2015-168196 | A | 9/2015 |

OTHER PUBLICATIONS

Extended European Search Report issued in related European Patent Application No. 18164386.7, dated Dec. 13, 2018.

* cited by examiner

BEFORE CHANGE

| RANK | THE NUMBER OF CHANNELS | OUTPUT VOLTAGE(V) |
|---|---|---|
| RANK 1 | 150 | 26.4 |
| RANK 2 | 600 | 27.2 |
| RANK 3 | 450 | 28.0 |
| RANK 4 | 300 | 28.8 |
| RANK 5 | 180 | 29.6 |

AFTER CHANGE

| RANK | THE NUMBER OF CHANNELS | OUTPUT VOLTAGE(V) |
|---|---|---|
| RANK 1 | 150 | 26.4 |
| RANK 2 | 600 | 27.2 |
| RANK 3 | 450 | 28.0 |
| RANK 4 | 300 | 29.6 |
| RANK 5 | 180 | 29.6 |

BEFORE CHANGE

| RANK | THE NUMBER OF CHANNELS | OUTPUT VOLTAGE(V) |
|---|---|---|
| RANK 1 | 50 | 26.0 |
| RANK 2 | 450 | 26.4 |
| RANK 3 | 600 | 26.8 |
| RANK 4 | 500 | 27.2 |
| RANK 5 | 80 | 27.6 |

AFTER CHANGE

| RANK | THE NUMBER OF CHANNELS | OUTPUT VOLTAGE(V) |
|---|---|---|
| RANK 1 | 50 | 26.0 |
| RANK 2 | 150 | 26.4 |
| RANK 3 | 600 | 26.8 |
| RANK 4 | 800 | 27.2 |
| RANK 5 | 80 | 27.6 |

Fig. 14

BEFORE CHANGE

| RANK | THE NUMBER OF CHANNELS | OUTPUT VOLTAGE(V) |
|---|---|---|
| RANK 1 | 130 | 26.0 |
| RANK 2 | 850 | 26.8 |
| RANK 3 | 500 | 27.6 |
| RANK 4 | 150 | 28.4 |
| RANK 5 | 50 | 29.2 |

↓

AFTER CHANGE 1

| RANK | THE NUMBER OF CHANNELS | OUTPUT VOLTAGE(V) |
|---|---|---|
| RANK 1 | 130 | 26.0 |
| RANK 2 | 50 | 26.8 |
| RANK 3 | 1300 | 27.6 |
| RANK 4 | 150 | 28.4 |
| RANK 5 | 50 | 29.2 |

↓

AFTER CHANGE 2

| RANK | THE NUMBER OF CHANNELS | OUTPUT VOLTAGE(V) |
|---|---|---|
| RANK 1 | 130 | 26.0 |
| RANK 2 | 50 | 26.8 |
| RANK 3 | 500 | 27.6 |
| RANK 4 | 950 | 28.4 |
| RANK 5 | 50 | 29.2 |

LIQUID JETTING APPARATUS

CROSS REFERENCE TO RELATED APPLICATION

The present application claims priority from Japanese Patent Application No. 2017-072999 filed on Mar. 31, 2017, the disclosure of which is incorporated herein by reference in its entirety.

BACKGROUND

Field of the Invention

The present invention relates to a liquid jetting apparatus configured to jet liquid, for example, ink.

Description of the Related Art

There is conventionally known an ink-jet recording apparatus that drives recording elements of a recording head by using first drive power, second drive power greater than the first drive power, or a third drive power greater than the first drive power and smaller than the second drive power (e.g., see Japanese Patent Application laid-open No. 2013-154595).

The ink-jet recording apparatus firstly drives the recording elements by using the first drive power, then drives the recording elements by using the third drive power, and lastly drives the recording elements by using the second drive power. Gradually changing the drive power prevents rapid change in density of an image.

SUMMARY

An equal change amount is added to a current drive power every time the drive power changes. A certain amount of time is needed after the drive power is changed before a voltage value driving the recording elements stabilizes. When the change amount is large, the recording elements may be driven before the voltage value stabilizes, which may cause ink jetting failure.

The present teaching has been made in view of the above circumstances, and an object of the present teaching is to provide a liquid jetting apparatus configured to change a voltage value by using an appropriate change value when the voltage value to be output from a power source to each drive element is changed.

According to the present teaching, there is provided a liquid jetting apparatus including: a head including nozzles and driving elements arranged to correspond to the nozzles; a power source connected to the driving elements; and a control circuit connected to the power source. The control circuit determines whether an output voltage value of the power source is changed from a first voltage value to a second voltage value. When the control circuit has determined that the output voltage value is changed from the first voltage value to the second voltage value, the control circuit calculates an absolute value of a difference between the first voltage value and the second voltage value and compares the absolute value of the difference and a threshold value. When the absolute value of the difference is equal to or more than the threshold value, the control circuit determines a calculation voltage value smaller than the absolute value of the difference.

BRIEF DESCRIPTION OF THE DRAWINGS

FIG. 14 is an illustrative view of a second mode.

DESCRIPTION OF THE EMBODIMENTS

First Embodiment

A printing apparatus according to a first embodiment is explained below with reference to the drawings.

Figure 1:
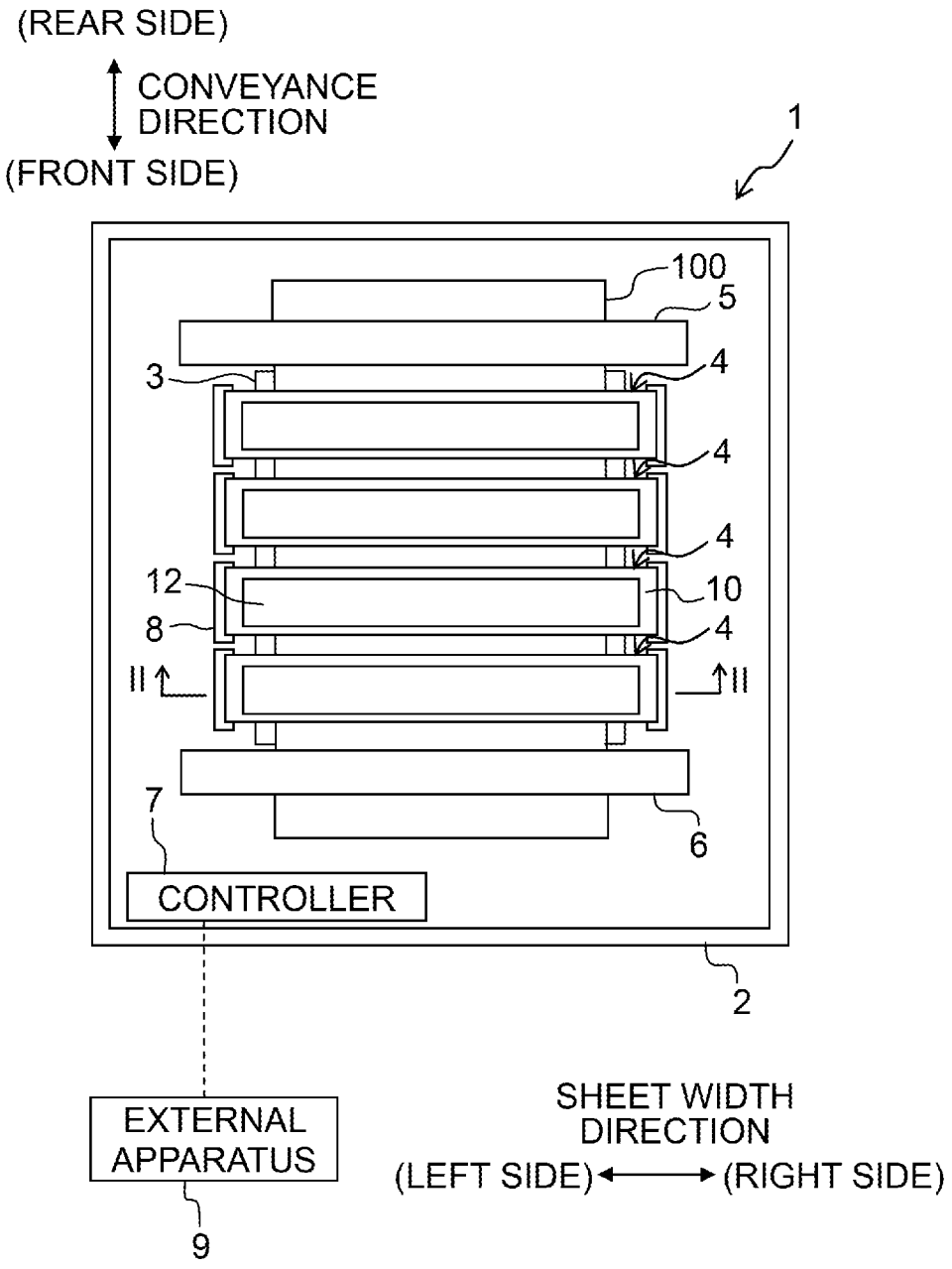
FIG. 1 is a schematic plan view of a printing apparatus according to a first embodiment.

In FIG. 1, a downstream side of a recording sheet 100 in a conveyance direction is defined as a front side of a printing apparatus 1, and an upstream side of the recording sheet 100 in the conveyance direction is defined as a rear side of the printing apparatus 1. A sheet width direction parallel to a surface on which the recording sheet 100 is conveyed (a surface parallel to a paper surface of FIG. 1) and orthogonal to the conveyance direction is defined as a left-right direction of the printing apparatus 1. The left side in FIG. 1 is the left side of the printing apparatus 1, and the right side in FIG. 1 is the right side of the printing apparatus 1. A direction perpendicular to the surface on which the recording sheet 100 is conveyed (a direction perpendicular to the paper surface of FIG. 1) is defined as an up-down direction of the printing apparatus 1. A front surface of FIG. 1 is the upper side, and a back surface of FIG. 1 is the lower side. In the following, the explanation is made by appropriately using the front, rear, left, right, up (upper), and down (lower) directions.

As depicted in FIG. 1, the printing apparatus 1 includes a casing 2, a platen 3, four ink-jet heads 4, two conveyance rollers 5 and 6, and a controller 7.

The platen 3 is placed in the casing 2. An upper surface of the platen 3 supports the recording sheet 100 conveyed by using any of the two conveyance rollers 5 and 6. The four ink-jet heads 4 are disposed above the platen 3 such that they are arranged in the front-rear direction. The conveyance roller 5 is disposed on the rear side of the platen 3 and the conveyance roller 6 is disposed on the front side of the platen 3. The two conveyance rollers 5 and 6 are driven by an unillustrated motor. The motor causes the two conveyance rollers 5 and 6 to convey the recording sheet 100 on the platen 3 frontward.

The controller 7 is connected to an external apparatus 9 such as a PC to perform data communication therebetween. The controller 7 controls parts or components of the printing apparatus 1 based on printing data sent from the external apparatus 9.

For example, the controller 7 controls the motor driving the two driving rollers 5 and 6 to cause the conveyance rollers 5 and 6 to convey the recording sheet 100 in the conveyance direction. Further, the controller 7 controls the ink-jet head 4 to jet ink onto the recording sheet 100 during conveyance of the recording sheet 100 by use of the two conveyance rollers 5 and 6. Accordingly, an image is printed on the recording sheet 100.

The casing 2 includes four head holders 8. The four head holders 8 are disposed above the platen 3 such that they are arranged in the front-rear direction between the two conveyance rollers 5 and 6. Each of the head holders 8 holds the corresponding one of the ink-jet heads 4.

The four ink-jet heads 4 respectively jet inks of four colors (cyan (C), magenta (M), yellow (Y), and black (K)). Each of the inks is supplied from the corresponding one of ink tanks (not depicted) to the corresponding one of the ink-jet heads 4.

Figure 2:
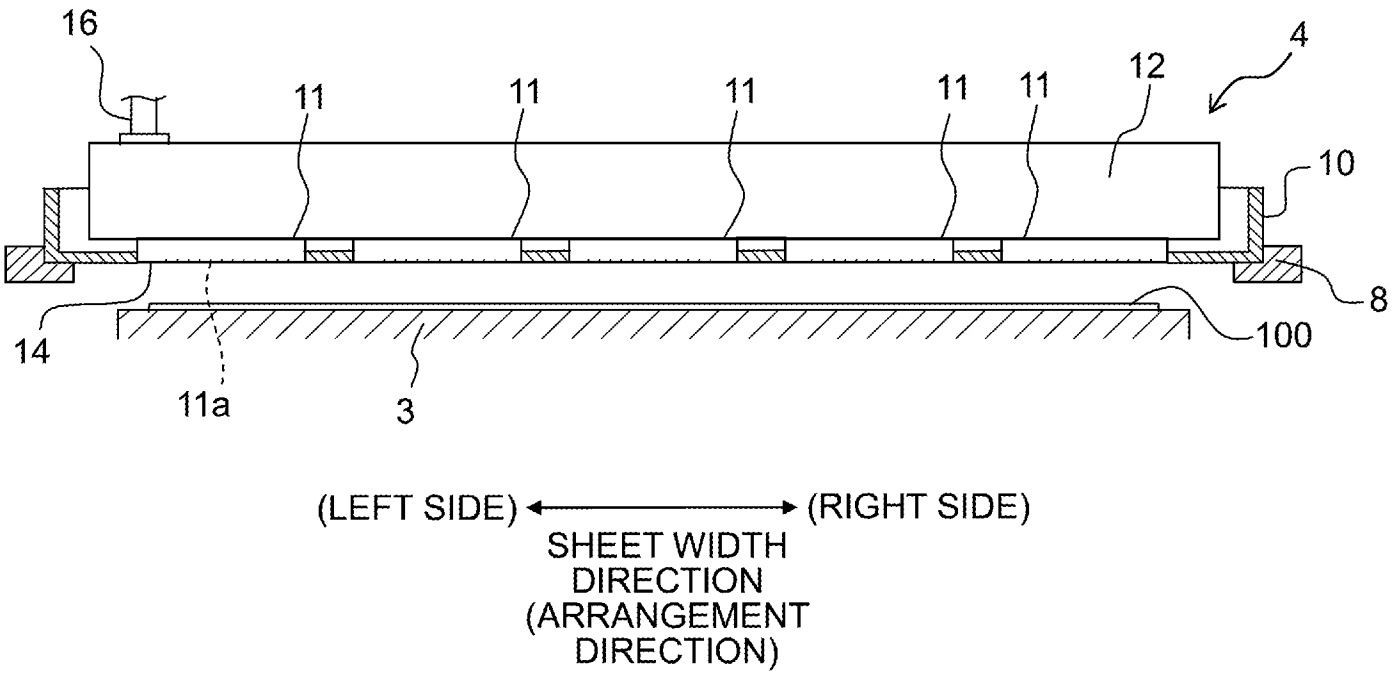
FIG. 2 is a schematic cross-sectional view taken along a line II-II depicted in FIG. 1.

As depicted in FIG. 2, each of the ink-jet heads 4 includes a holder 10 and head units 11. The holder 10 has a rectangular plate shape that is long in the sheet width direction. The holder 10 holds the head units 11.

Figure 3:
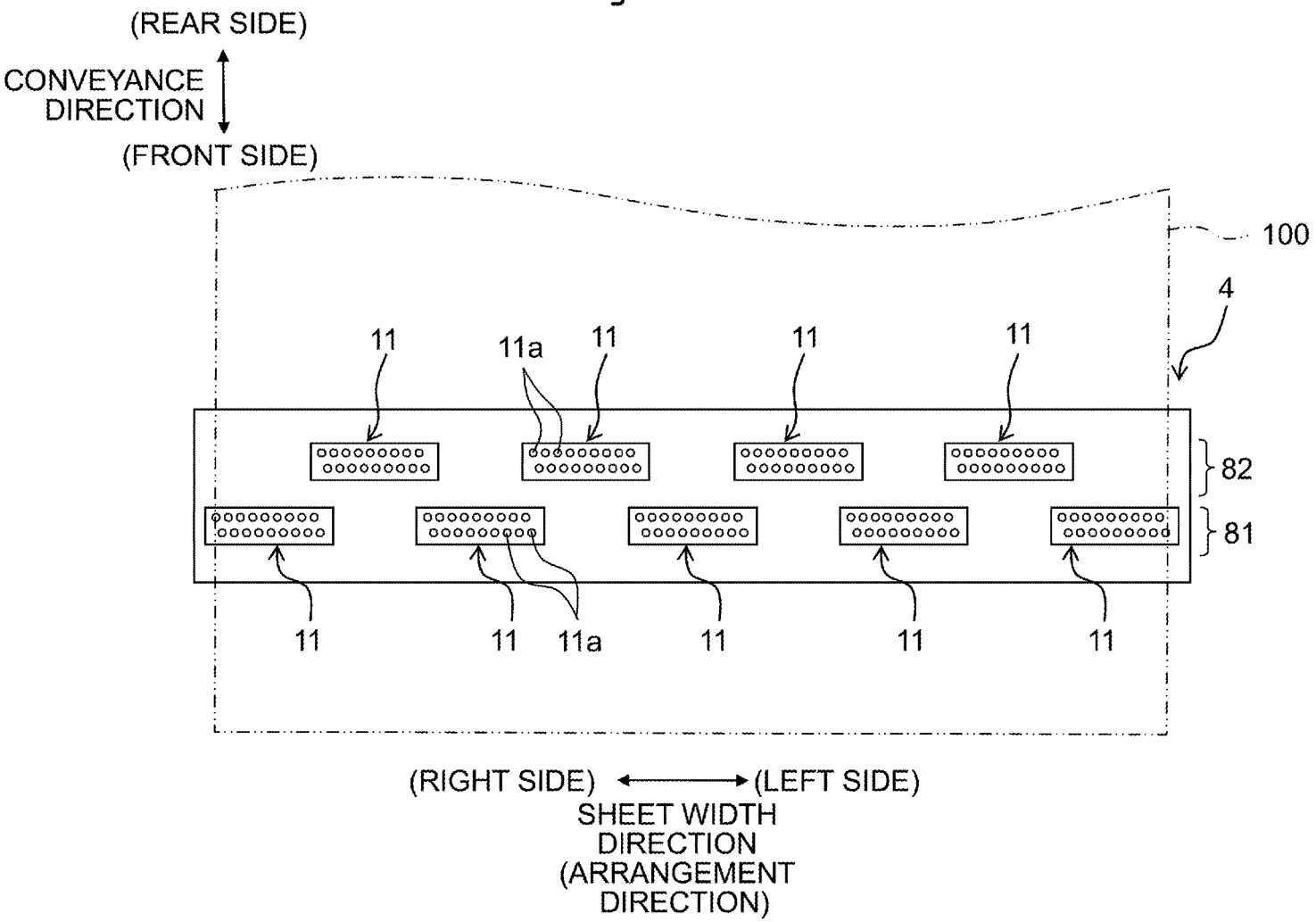
FIG. 3 is a bottom view of an ink-jet head.

A lower surface of each head unit 11 includes nozzles 11*a*. Each nozzle 11*a* communicates with a channel 11*p* (see FIG. 6). As depicted in FIG. 3, the nozzles 11*a* of the head unit 11 are arranged in the sheet width direction that is a longitudinal direction of the ink-jet head 4. The head units 11 are arranged zigzag in the conveyance direction and the sheet width direction (arrangement direction).

In the following, the head units 11 on the front side in the conveyance direction (the downstream side in the conveyance direction) form a first head row 81. The head units 11 on the rear side in the conveyance direction (the upstream side in the conveyance direction) form a second head row 82. As depicted in FIG. 3, a left end of each head unit 11 of the first head row 81 is substantially the same position as a right end of each head unit 11 of the second head row 82 in the left-right direction. Each head unit 11 is electrically connected to the controller 7.

As depicted in FIGS. 1 and 2, a reservoir 12 is arranged above the head units 11. The reservoir 12 is connected to the ink tank (not depicted) via a tube 16. The reservoir 12 temporarily contains the ink supplied from the ink tank. A lower portion of the reservoir 12 is connected to the corresponding head units 11. Each ink is supplied from the corresponding reservoir 12 to the corresponding head units 11.

Figure 4:
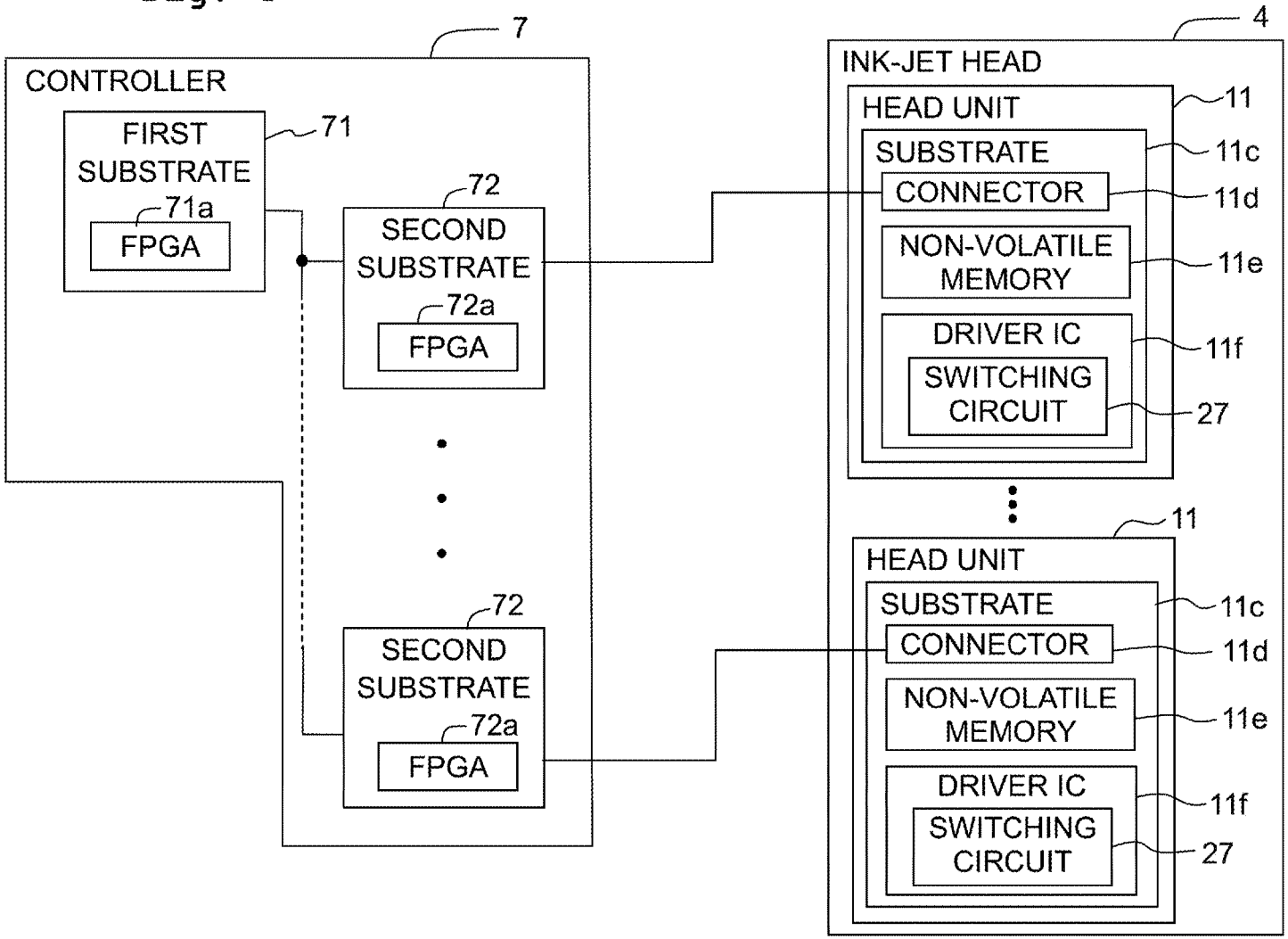
FIG. 4 is a schematic block diagram depicting connection between a controller and a head unit.
Figure 5:
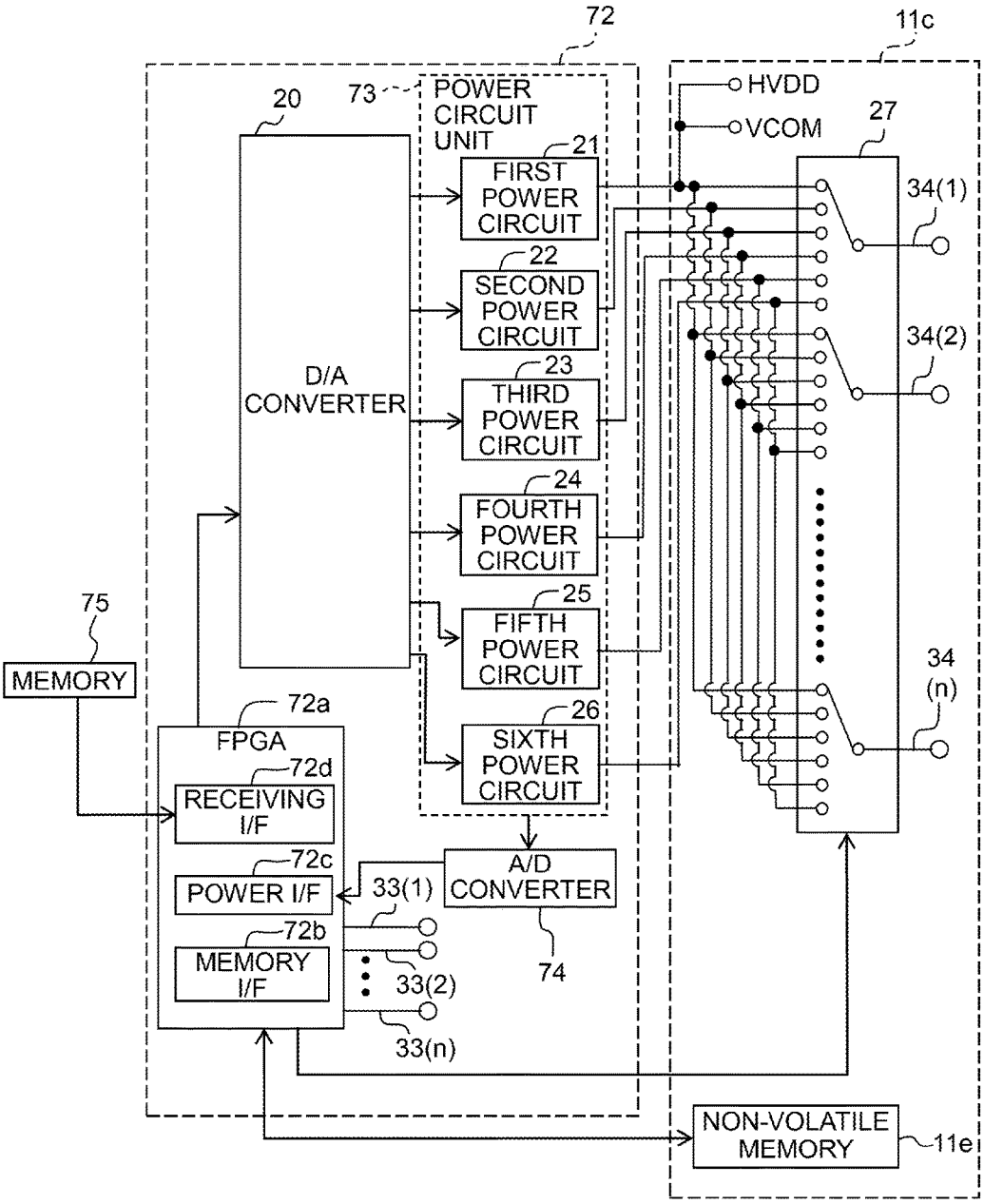
FIG. 5 is a schematic block diagram of a configuration in the vicinity of a power circuit.

As depicted in FIG. 4, the controller 7 includes a first substrate 71 and second substrates 72. The first substrate 71 includes a Field Programmable Gate Array (FPGA) 71*a*. Each second substrate 72 includes a FPGA 72*a*. As depicted in FIG. 5, the FPGA 72*a* includes a memory interface (memory I/F) 72*b*, a power interface (power I/F) 72*c*, and a receiving interface (receiving I/F) 72*d*.

The FPGA 71*a* is connected to the multiple FPGAs 72*a* to control driving of the multiple FPGAs 72*a*. The number of FPGAs 71*a* is the same as the number of ink-jet heads 4. The FPGAs 72*a* correspond to the head units 11, respectively. The FPGAs 72*a* are connected to the head units 11, respectively. Namely, the number of FPGAs 72*a* is the same as the number of head units 11 included in each ink-jet head 4.

As depicted in FIG. 4, each head unit 11 includes a substrate 11*c*. The substrate 11*c* includes a removable connector 11*d*, a non-volatile memory 11*e*, and a driver IC 11*f*. Each head unit 11 is removably connected to the corresponding second substrate 72 via the connector 11*d*. The driver IC 11*f* includes a switching circuit 27 described below.

As depicted in FIG. 5, the second substrate 72 includes a Digital/Analog (D/A) converter 20. The second substrate 72 includes a power circuit unit 73. The power circuit unit 73 includes power circuits, for example, a first power circuit 21 to a sixth power circuit 26. The first power circuit 21 to the sixth power circuit 26 each have a FET, a resistance, and the like to change output voltage. The second substrate 72 includes an A/D converter 74.

The first power circuit 21 to the sixth power circuit 26 are connected to the FPGA 72*a* via the D/A converter 20 and the A/D converter 74. The FPGA 72*a* outputs a signal for setting the output voltage to each of the first power circuit 21 to the sixth power circuit 26 via the D/A converter 20. Each of the first power circuit 21 to the sixth power circuit 26 inputs the output voltage to the FPGA 72*a* via the A/D converter 74 and the power I/F 72*c*.

As depicted in FIGS. 4 and 5, each of the first power source circuit 21 to the sixth power source circuit 26 is connected to any of power wires 34(*n*) (n=1, 2, . . . ) via the switching circuit 27 of the driver IC 11*f*. The number of power wires 34(*n*) corresponds to the number of pairs of piezoelectric bodies 11*b*, 11*b*' described below, in other words, the number of channels 11*p*. Namely, the number of power wires 34(*n*) is equal to the number of channels 11*p*. The switching circuit 27 causes each of the power wires 34(*n*) to be connected to any of the first power circuit 21 to the sixth power circuit 26. For example, of the first power circuit 21 to the sixth power circuit 26, the first power circuit 21 has a highest output voltage, and the output side of the first power circuit 21 is connected to a terminal of HVDD and a terminal of VCOM.

Figure 6:
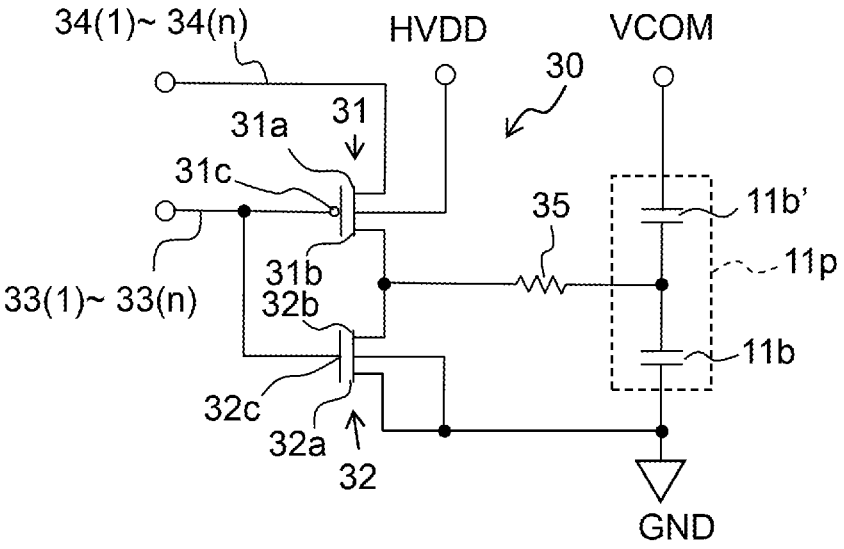
FIG. 6 is a schematic circuit diagram of a configuration of a Complementary Metal-Oxide-Semiconductor (CMOS) circuit driving each nozzle.

As depicted in FIG. 6, the printing apparatus 1 includes a Complementary Metal-Oxide-Semiconductor (CMOS) circuit 30 driving the piezoelectric bodies 11*b* and 11*b*'. The number of CMOS circuits 30 corresponds to the number of pairs of the piezoelectric bodies 11*b*, 11*b*'. For example, the number of CMOS circuits 30 is equal to the number of pairs of the piezoelectric bodies 11*b*, 11*b*'. The FPGA 72*a* outputs a gate signal to the CMOS circuit 30 via control wires 33(*n*) (n=1, 2, . . . ). The control wires 33(*n*) correspond to the power wires 34(*n*).

For example, the FPGA 72*a* outputs, to the switching circuit 27, a signal for causing each of the power wires 34(*n*) to be connected to any of the first power circuit 21 to the sixth power circuit 26. The FPGA 72*a* accesses the non-volatile memory 11*e* via the memory I/F 72*b*. The non-volatile memory 11*e* stores information such as nozzle addresses for identifying the respective nozzles 11*a* and voltages corresponding to the respective nozzle addresses.

The external memory 75 stores bit stream information for executing voltage change processing described below. The FPGA 72*a* includes circuit components forming a logic circuit. The FPGA 72*a* receives the bit stream information from the memory 75 via the receiving I/F 72*d*. The FPGA 72*a* builds a connection relation between the circuit components based on the bit stream information received. This causes the FPGA 72*a* to form the logic circuit executing the voltage change processing. The non-volatile memory 11*e* may store the bit stream information. In that case, the FPGA 72*a* may receive the bit stream information via the memory I/F 72*b*.

As depicted in FIG. 6, the CMOS circuit 30 includes, for example, a P-type Metal-Oxide-Semiconductor (PMOS) transistor 31, a N-type Metal-Oxide-Semiconductor (NMOS) transistor 32, a resistance 35, and two piezoelectric bodies 11*b*, 11*b*'. The piezoelectric bodies 11*b*, 11*b*' function as a capacitor. It is allowable to only provide the piezoelectric body 11*b*. A source terminal 31*a* of the PMOS transistor 31 is connected, for example, to the n-th power wire 34(*n*). A source terminal 32*a* of the NMOS transistor 32 is connected to the ground.

Drain terminals 31*b*, 32*b* of the PMOS transistor 31 and the NMOS transistor 32 are connected to a first end of the resistance 35. A second end of the resistance 35 is connected to a second end of the piezoelectric body 11*b*' and to a first end of the piezoelectric body 11*b*. A first end of the piezoelectric body 11*b*' is connected to the terminal of VCOM (a common power source) and a second end of the piezoelectric body 11*b* is connected to the ground.

Gate terminals 31*c*, 32*c* of the PMOS transistor 31 and the NMOS transistor 32 are connected to any of the control wires 33(1) to 33(*n*). Any of the control wires 33(1) to 33(*n*) corresponds to the power wire connected to the source terminal 31*a* of the PMOS transistor 31. The PMOS transistor 31 is connected to the terminal of HVDD (a power source on the drain-side).

The PMOS transistor 31 becomes conductive when the FPGA 72*a* inputs an "L" output signal to the gate terminal 31*c* of the PMOS transistor 31 and the gate terminal 32*c* of the NMOS transistor 32. This makes the piezoelectric body 11*b* a charge state and makes the piezoelectric body 11*b*' a discharge state. The NMOS transistor 33 becomes conductive when the FPGA 72*a* inputs a "H" output signal to the gate terminal 31*c* of the PMOS transistor 31 and the gate terminal 32*c* of the NMOS transistor 32. This makes the piezoelectric body 11*b* the discharge state and makes the piezoelectric body 11*b*' the charge state. The piezoelectric bodies 11*b*, 11*b*' are deformed by making the piezoelectric body 11*b* the charge state and making the piezoelectric body 11*b*' the discharge state. The deformation of the piezoelectric bodies 11*b*, 11*b*' changes the volume in the channel 11*p*. The change in volume in the channel 11*p* jets ink from each nozzle 11*a*.

Figure 7:
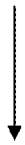
FIG. 7 is an exemplary table indicating relations between ranks of first to sixth power circuits, the number of channels mapped to the respective ranks, and output voltages of the first to sixth power circuits mapped to the respective ranks.

An exemplary relation between a rank of each of the first power circuit 21 to the sixth power circuit 26, the number of channels mapped to one of the ranks, and the output voltage of each of the first power circuit 21 to the sixth power circuit 26 having the corresponding one of the ranks is explained while referring to FIG. 7. FIG. 7 includes a table before output voltage is changed and a table after output voltage is changed. The table before output voltage is changed is stored in the memory 75 in advance. After output voltage is changed, the table after output voltage is changed is stored in the memory 75.

Each rank is determined depending on the speed of liquid droplets (ink droplets) jetted from each nozzle 11*a*. For example, the liquid droplet speed is set to have five speed widths so that the speed widths are mapped to a rank 1 to a rank 5, respectively. The nozzle address of each nozzle 11*a* is mapped to any of the ranks 1 to 5 and then stored in the non-volatile memory 11*e*. In this embodiment, the liquid droplet speed is used as an example, but it is possible to similarly use a jetting amount of liquid droplets instead of the liquid droplet speed.

The number of channels means the number of channels 11*p* mapped to each of the ranks. As described above, each of the channels 11*p* communicates with the corresponding one of nozzles 11*a*. Thus, the number of nozzles 11*a* mapped to each of the ranks corresponds to the number of channels.

Six power circuits are allocated to the five ranks. Two power circuits of the six power circuits are allocated to a rank having a largest number of the channels. For example, as indicated in the table before output voltage is changed in FIG. 7, two power circuits are allocated to the rank 2 having the largest number of the channels, and one power circuit is allocated to each of the ranks 1, and 3 to 5. The first power circuit 21 to the sixth power circuit 26 are connected to the respective channels 11*p* mapped to the respective ranks allocated.

Figure 8:
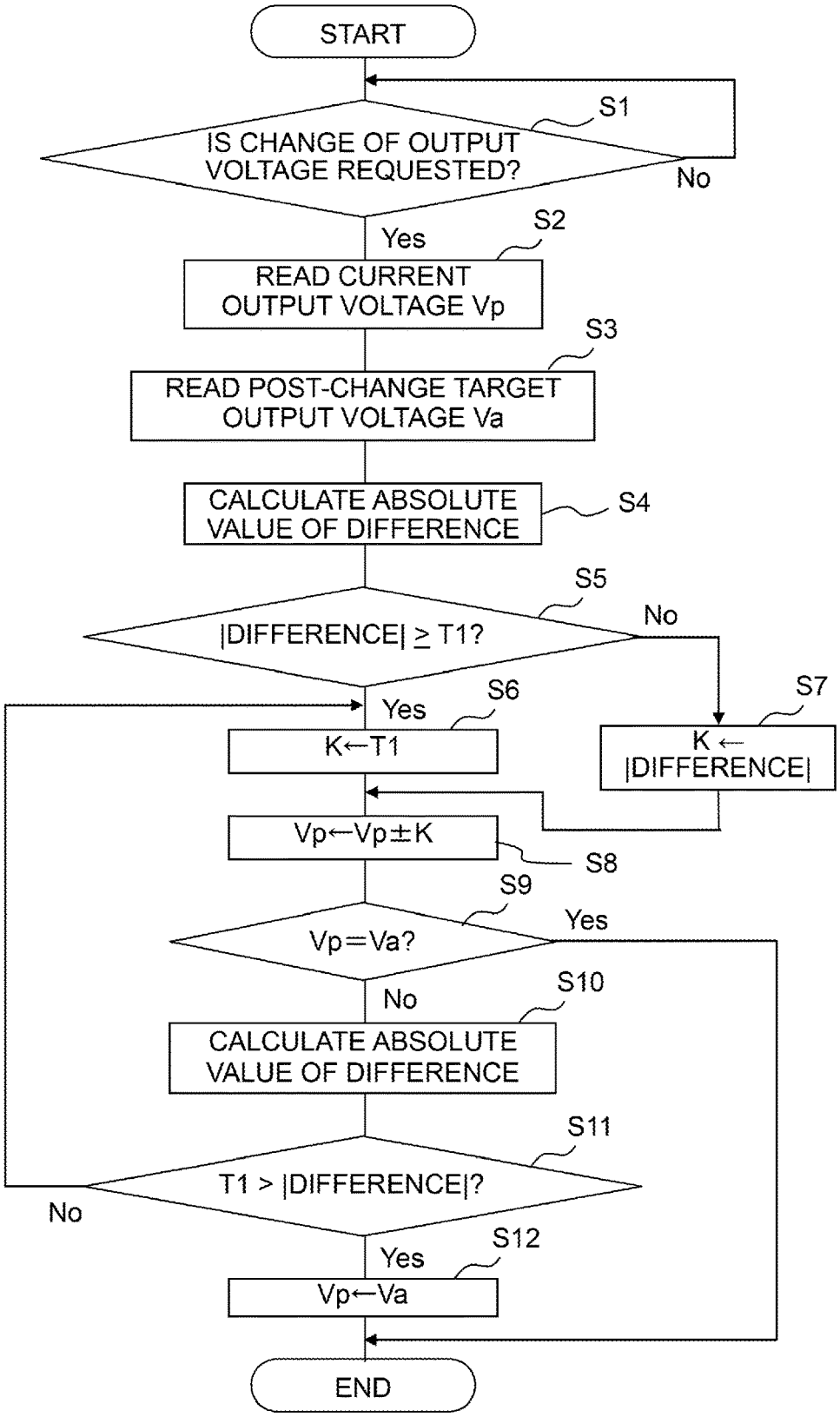
FIG. 8 is a flowchart illustrating output-voltage change processing.

Next, output-voltage change processing is explained while referring to FIG. 8. The FPGA 72*a* determines whether the change of output voltage of the power circuit that is connected to the nozzle 11*a* mapped to one of the ranks is requested (step S1). For example, when the temperature decreases or when the cumulative number of times of driving exceeds a threshold value, the increase in voltage is requested. On the other hand, for example, when the temperature increases, the decrease in voltage is requested. When the change of output voltage of the power circuit is not requested (step S1: NO), the FPGA 72*a* repeats the processing of the step S1.

When the change of output voltage of the power circuit that is connected to the nozzle 11*a* mapped to one of the ranks is requested (step S1: YES), the FPGA 72*a* reads a current output voltage Vp of the power circuit from the memory 75 (step S2). For example, when the change of output voltage of the power circuit, which is connected to 300 channels 11*p* mapped to the rank 4, is requested, the FPGA 72*a* reads 28.8 V (see FIG. 7) from the memory 75.

The FPGA 72*a* reads a post-change target output voltage Va from the memory 75 (step S3). For example, when the post-change target output voltage Va is 29.6 V, the FPGA 72*a* reads 29.6 V from the memory 75 (see FIG. 7). For example, when the post-change target output voltage Va is 28.0 V, the FPGA 72*a* reads 28.0 V from the memory 75 (see FIG. 7). The FPGA 72*a* calculates an absolute value of a difference between the Vp and the Va (step S4), and determines whether the absolute value of the difference calculated is equal to or more than a threshold value T1 (step S5).

The threshold value TI is stored in the memory 75 in advance. The average value of a current that drives the channels 11*p* is in proportion to a voltage to be applied to each channel 11*p*, a jetting frequency, a capacity of the piezoelectric bodies 11*b*, 11*b*', the number of times of vibration of the piezoelectric bodies 11*b*, 11*b*' during one period of the jetting frequency, the number of channels, and the like. The threshold value T1 is determined, for example, based on an equation or relation representing the above proportional relation.

When the difference calculated is equal to or more than the threshold value T1 (step S5: YES), the FPGA 72*a* sets T1 to a variable K (step S6). At the next printing timing, the FPGA 72*a* adds or subtracts the K to or from the Vp (step S8). Specifically, when Va>Vp is satisfied, the FPGA 72*a* adds the K (=T1) to the Vp. This changes, for example, the output voltage of the power circuit that is connected to 300 channels 11*p* mapped to the rank 4, from 28.8 V to 29.6 V. When Va<Vp is satisfied, the FPGA 72*a* subtracts the K (=T1) from the Vp. This changes, for example, the output voltage of the power circuit that is connected to 300 channels 11*p* mapped to the rank 4, from 28.8 V to 28.0 V.

When the difference calculated is less than the threshold value T1 (step S5: NO), the FPGA 72*a* sets an absolute value of the difference to the variable K (step S7). At the next printing timing, the K is added to or subtracted from the Vp (step S8). Specifically, when Va>Vp is satisfied, the FPGA 72*a* adds the K (=the absolute value of the difference) to the Vp. This changes, for example, the output voltage of the power circuit that is connected to 300 channels 11*p* mapped to the rank 4, from 28.8 V to 29.6 V. When Va<Vp is satisfied, the FPGA 72*a* subtracts the K (=the absolute value of the difference) from the Vp. This changes, for example, the output voltage of the power circuit that is connected to 300 channels 11*p* mapped to the rank 4, from 28.8 V to 28.0 V.

After the step S8, the FPGA 72*a* determines whether the current output voltage Vp is the target output voltage Va (step S9). When the current output voltage Vp is not the target output voltage Va (step S9: NO), the FPGA 72*a* calculates an absolute value of a difference between the Vp and the Va (step S10). The FPGA 72*a* determines whether the absolute value of the difference calculated is less than the threshold value T1 (step S11).

When the absolute value of the difference is equal to or more than the threshold value T1 (step S11: NO), the FPGA 72*a* makes the processing return to the step S6. When the absolute value of the difference is less than the threshold value T1 (step S11: YES), the FPGA 72*a* changes the current output voltage Vp into the target output voltage Va (step S12), and ends the processing.

In the step S9, when the current output voltage Vp is the target output voltage Va (step S9: YES), the FPGA 72*a* ends the processing.

In the first embodiment, when the output voltage value of the power circuit is changed from the current output voltage value Vp (a first voltage value) to the target output voltage value Va (a second voltage value), the FPGA 72*a* calculates an absolute value of a difference between the Vp and the Va. When the absolute value of the difference calculated is equal to or more than the threshold value T1 and when printing timing (first timing) has arrived, a calculation voltage value smaller than the absolute value of the difference, for example, the threshold value T1, is added to or subtracted from the Vp. Then, when next printing timing (second timing) has arrived, the calculation voltage value is added to or subtracted from the Vp. Since the calculation voltage value is smaller than the absolute value of the difference, the output voltage of the power circuit stabilizes in a short time after the addition or subtraction of the calculation voltage value.

When the difference calculated is less than the threshold value T1 and when printing timing (any of the first timing and the second timing) has arrived, the absolute value of the difference is added to or subtracted from the Vp. Since the absolute value of the difference is smaller than the threshold value T1, the output voltage of the power circuit stabilizes in a short time after the addition or subtraction of the absolute value of the difference.

The output voltage may be changed at the timing described below. As depicted in FIG. 7, the number of channels 11*p* driven that is mapped to the rank 4 is 300 before output voltage is changed.

The FPGA 72*a* reads, in advance, the number of channels 11*p* driven that is mapped to the rank 4 by a predefined number of times of printing, for example, 50 to 300 times of printing. Then, the FPGA 72*a* determines a period T (see FIG. 9) during which the number of channels 11*p* driven that is mapped to the rank 4, which has been read in advance, is equal to or less than a half of the predefined number of times of printing (e.g., 150 or less). The FPGA 72*a* changes the output voltage during the period T obtained.

Since the output voltage is changed during the period T having a small number of channels 11*p* driven, it is possible to minimalize the influence on density of the image formed on the recording sheet 100.

Second Embodiment

Figure 10:
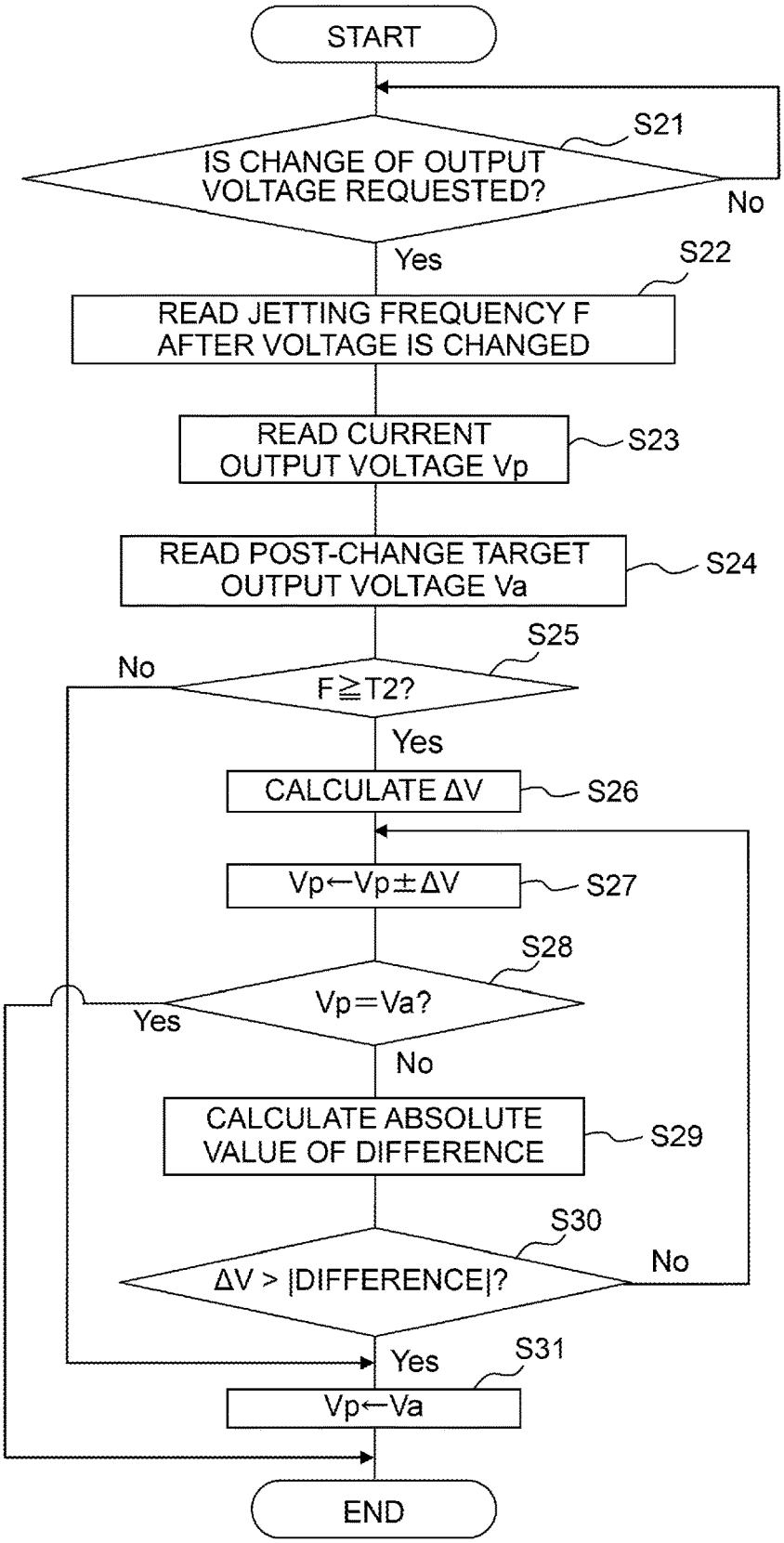
FIG. 10 is a flowchart illustrating output-voltage change processing according to a second embodiment.

In the following, a printing apparatus according to a second embodiment of the present teaching is described below with reference to FIG. 10. The FPGA 72*a* determines whether or not the change of output voltage of the power circuit that is mapped to one of the ranks is requested (step S21). When the change of output voltage of the power circuit is not requested (step S21: NO), the FPGA 72*a* repeats the processing of step S21.

When the change of output voltage of the power circuit is requested (step S21: YES), the FPGA 72*a* reads, from the controller 7, a jetting frequency F after voltage is changed (step S22). The jetting frequency F is the inverse of a jetting period during which liquid is jetted from the nozzles 11*a*. The jetting period is time required to jet the liquid from the nozzle 11*a* by an amount corresponding to one jetting. The jetting frequency F is determined based on printing data transmitted from the external apparatus 9 to the controller 7.

After the step S22, the FPGA 72*a* reads the current output voltage Vp of the power circuit from the memory 75 (step S23), and reads the post-change target output voltage Va from the memory 75 (step S24). For example, when the output voltage of the power circuit that is connected to 300 channels 11*p* mapped to the rank 4 is changed from 28.8 V to 29.6 V, the FPGA 72*a* operates as follows. Namely, the FPGA 72*a* reads the current output voltage of 28.8 V from the memory 75 (step S23) and reads the post-change target output voltage of 29.6 V from the memory 75 (step S24). For example, when the output voltage of the power circuit that is connected to 300 channels 11*p* mapped to the rank 4 is changed from 28.8 V to 28.0 V, the FPGA 72*a* operates as follows. Namely, the FPGA 72*a* reads the current output voltage of 28.8 V from the memory 75 (step S23) and reads the post-change target output voltage of 28.0 V from the memory 75 (step S24).

The FPGA 72*a* determines whether the jetting frequency F read in the step S22 is equal to or more than a threshold value T2 (step S25). The threshold value T2 is stored in the memory 75 in advance. The threshold value T2 is determined, for example, based on an equation or relation representing the above proportional relation.

When the jetting frequency F is less than the threshold value T2 (step S25: NO), the FPGA 72*a* changes the current output value Vp into the target output value Va (step S31) and ends the processing. When the jetting frequency F is equal to or more than the threshold value T2 (step S25: YES), the FPGA 72*a* calculates a calculation voltage value ΔV (ΔV≥0) (step S26). The calculation voltage value ΔV is calculated, for example, by $\Delta V_{max}/(F/T2)$ when a maximum value of a voltage change value is $\Delta V_{max}$.

At the next printing timing, the FPGA 72*a* adds or subtracts the ΔV to or from the Vp (step S27). Specifically, when Va>Vp is satisfied, the FPGA 72*a* adds the ΔV to the Vp. This changes, for example, the output voltage of the power circuit that is connected to 300 channels 11*p* mapped to the rank 4, from 28.8 V to 29.6 V. When Va<Vp is satisfied, the FPGA 72*a* subtracts the ΔV from the Vp. This changes, for example, the output voltage of the power circuit that is connected to 300 channels 11*p* mapped to the rank 4, from 28.8 V to 28.0 V. The FPGA 72*a* determines whether the Vp is the Va (step S28). When the Vp is the Va (step S28: YES), the FPGA 72*a* ends the processing.

When the Vp is not the Va (step S28: NO), the FPGA 72*a* calculates an absolute value of a difference between the Va and the Vp (step S29) and determines whether the ΔV is larger than the absolute value of the difference (step S30). When the ΔV is equal to or less than the absolute value of the difference (step S30: NO), the FPGA 72*a* makes the processing return to the step S27. When the ΔV is larger than the absolute value of the difference (step S30: YES), the FPGA 72*a* changes the Vp into Va (step S31) and ends the processing.

Figure 9:
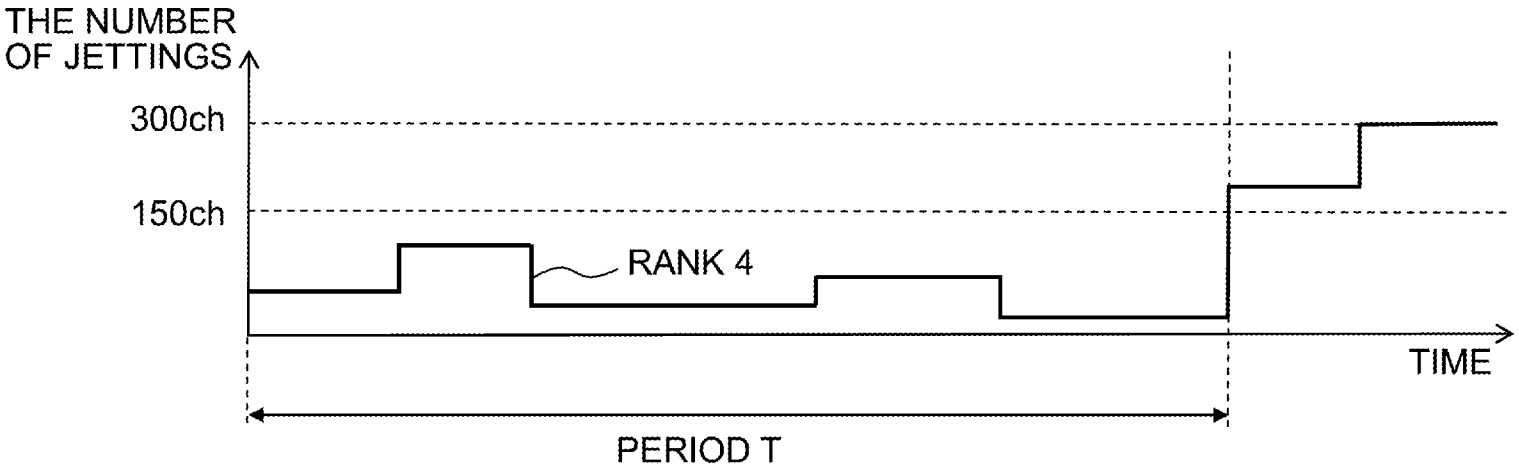
FIG. 9 is an exemplary timing chart that indicates the number of channels driven that is mapped to a rank 4.

As depicted in FIG. 9, the FPGA 72*a* may change the output voltage during a period during which the number of channels 11*p* driven that are mapped to the rank before output voltage is changed, which has been read in advance, becomes equal to or less than a half thereof or a period during which the total number of channels 11*p* driven that are mapped to the ranks before and after output voltage is changed is the smallest.

In the second embodiment, when the output voltage value of the power circuit is changed from the current output voltage value Vp (the first voltage value) to the target output voltage value Va (the second voltage value), the jetting frequency is compared to the threshold value T2. When the jetting frequency is equal to or more than the threshold value T2, the ΔV (the calculation voltage value) that is smaller than the absolute value of the difference between the Vp and the Va is determined. When the Va is larger than the Vp and when printing timing (the first timing) has arrived, the ΔV is added to the Vp. When the Va is smaller than the Vp and when the printing timing has arrived, the ΔV is subtracted from the Vp. Then, when next printing timing (the second timing) has arrived, the ΔV is added to the Vp or the ΔV is subtracted from the Vp. Since the ΔV is smaller than the voltage value of the difference, the output voltage of the power circuit stabilizes in a short time after addition or subtraction of the ΔV.

When the jetting frequency is less than the threshold value T2, the Vp is changed to the Va. In other words, the absolute value of the difference between the Vp and the Va is added to or subtracted from the Vp. When the jetting frequency is less than the threshold value T2, the difference between the Vp and the Va is small. Thus, the output voltage of the power circuit stabilizes in a short time when the Vp is directly changed to the Va.

The parts or components in the second embodiment that are the same as or equivalent to those of the first embodiment, are designated by the same reference numerals, and any explanation therefor will be omitted as appropriate.

Third Embodiment

Figure 11A:
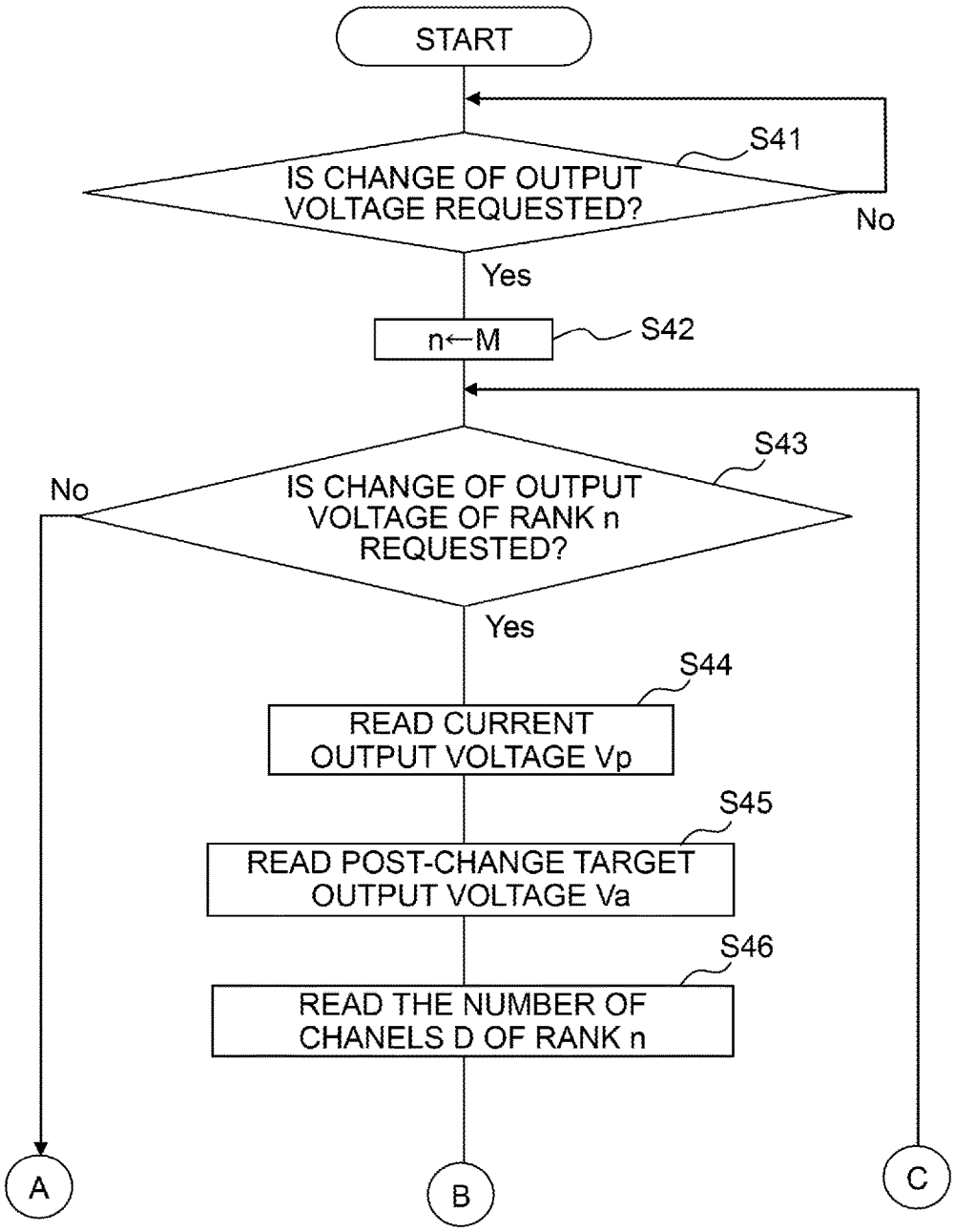
FIGS. 11A and 11B are a flowchart illustrating output-voltage change processing according to a third embodiment.
Figure 11B:
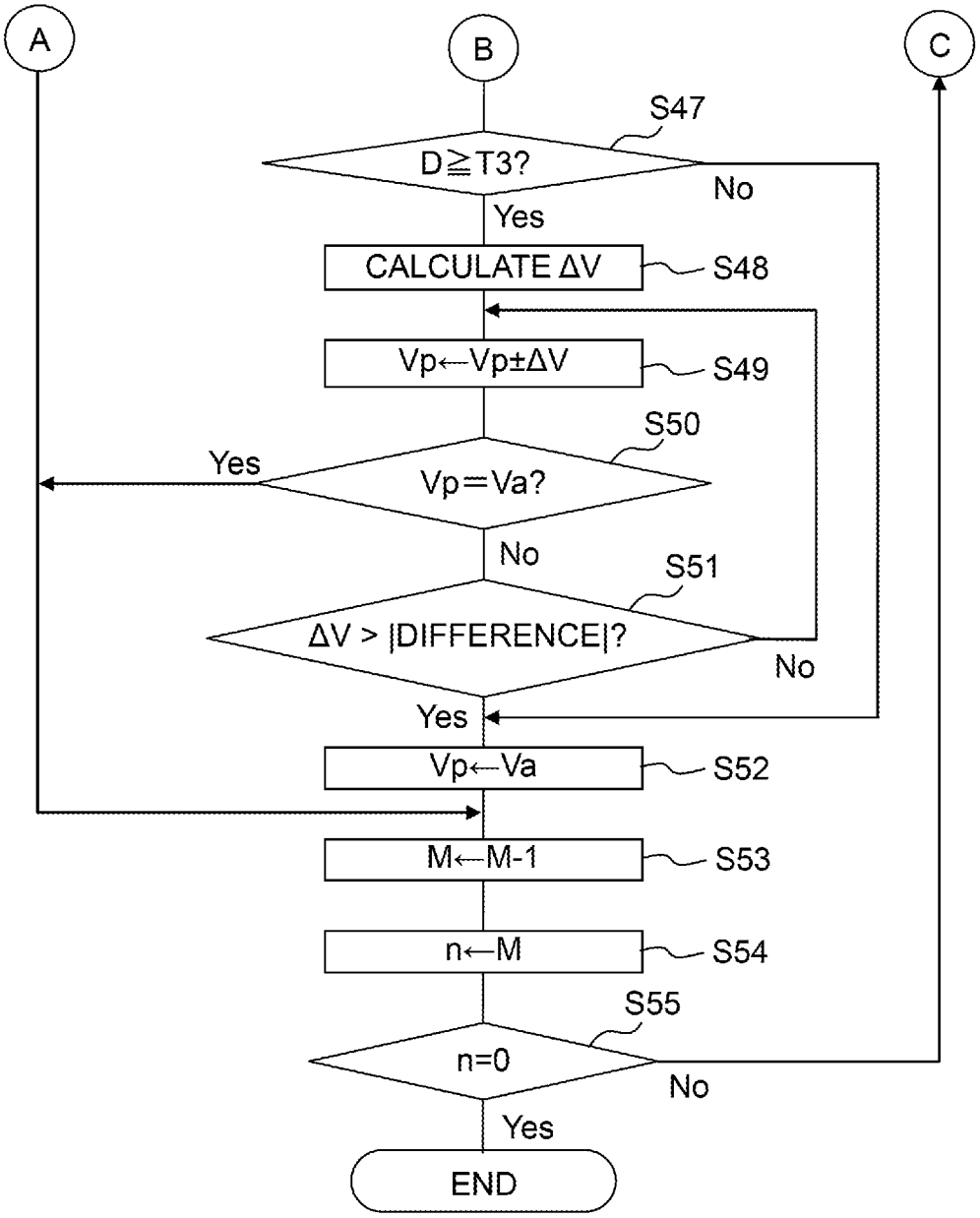

A printing apparatus according to a third embodiment of the present teaching is explained below with reference to FIGS. 11A and 11B. The FPGA 72*a* determines whether the change of output voltage of the power circuit is requested (step S41). When the change of output voltage of the power circuit is not requested (step S41: NO), the FPGA 72*a* repeats the processing of step S41.

When the change of output voltage of the power circuit is requested (step S41: YES), the FPGA 72*a* sets a maximum value M of the rank (five in the third embodiment) to a variable n (step S42), and determines whether the change of output voltage of a rank n is requested (step S43). The rank with a large numerical value has an output voltage value that is larger than that of the rank with a small numerical value, and the rank with the large numerical value has a great influence on the density of the image. Thus, the output voltage value of the rank with the large numerical value is changed preferentially.

When the change of the output voltage of the rank n is not requested (step S43: NO), the FPGA 72*a* subtracts one from the maximum value M (step S53), sets the maximum value M after subtraction to the rank n (step S54), and determines whether the rank n is 0 (step S55). When the rank n is 0 (step S55: YES), the FPGA 72*a* ends the processing. When the rank n is not 0 (step S55: NO), the FPGA 72*a* makes the processing return to the step S43.

When the change of output voltage of the rank n is requested in the step S43 (step S43: YES), the FPGA 72*a* reads the current output voltage Vp of the power circuit from the memory 75 (step S44), and reads the post-change target output voltage Va from the memory 75 (step S45). Then, the FPGA 72*a* reads the number of channels D of the rank n (step S46, see FIG. 7) and determines whether the number of channels D is equal to or more than a threshold value T3 (step S47). The threshold value T3 is stored in the memory 75 in advance.

For example, when the output voltage of the power circuit that is connected to 300 channels 11*p* mapped to the rank 4 is changed from 28.8 V to 29.6 V, the FPGA 72*a* operates as follows. Namely, the FPGA 72*a* reads the current output voltage of 28.8 V from the memory 75 (step S44), and reads the post-change target output voltage of 29.6 V from the memory 75 (step S45). Then, the FPGA 72*a* reads the number of channels mapped to the rank 4 (here, 300) (step S46), and determines whether the number of channels read (here, 300) is equal to or more than the threshold value T3 (step S47).

For example, when the output voltage of the power circuit that is connected to 300 channels 11*p* mapped to the rank 4 is changed from 28.8 V to 28.0 V, the FPGA 72*a* operates as follows. Namely, the FPGA 72*a* reads the current output voltage of 28.8 V from the memory 75 (step S44), and reads the post-change target output voltage of 28.0 V from the memory 75 (step S45). Then, the FPGA 72*a* reads the number of channels mapped to the rank 4 (here, 300) (step S46), and determines whether the number of channels read (here, 300) is equal to or more than the threshold value T3 (step S47).

When the number of channels D is less than the threshold value T3 (step S47: NO), the Vp is changed to the Va (step S52) and the FPGA 72*a* makes the processing proceed to the step S53. When the number of channels D is equal to or more than the threshold value T3 (step S47: YES), the FPGA 72*a* calculates the calculation voltage value ΔV (ΔV≥0) (step S48). The calculation voltage value ΔV is, for example, calculated by a relation (the absolute value of the difference between the Va and the Vp)/(the number of channels D/T3).

At the next printing timing, the FPGA 72*a* adds or subtracts the ΔV to or from the Vp (step S49). Specifically, when Va>Vp is satisfied, the FPGA 72*a* adds the ΔV to the Vp. This changes, for example, the output voltage of the power circuit that is connected to 300 channels 11*p* mapped to the rank 4, from 28.8 V to 29.6 V. When Va<Vp is satisfied, the FPGA 72*a* subtracts the ΔV from the Vp. This changes, for example, the output voltage of the power circuit that is connected to 300 channels 11*p* mapped to the rank 4 from 28.8 V to 28.0 V. The FPGA 72*a* determines whether the Vp is the Va (step S50). When the Vp is the Va (step S50: YES), the FPGA 72*a* makes the processing proceed to the step S53.

When the Vp is not the Va (step S50: NO), the FPGA 72*a* determines whether the ΔV is larger than the absolute value of the difference between the Va and the Vp (step S51). When the ΔV is equal to or less than the absolute value of the difference between the Va and the Vp (step S51: NO), the FPGA 72*a* makes the processing return to the step S49.

When the ΔV is larger than the absolute value of the difference between the Va and the Vp (step S51: YES), the Vp is changed to the Va (step S52). Then, the FPGA 72*a* executes the processing subsequent to the step S53.

As depicted in FIG. 9, the FPGA 72*a* may change the output voltage during a period during which the number of channels 11*p* driven that are mapped to the rank before output voltage is changed, which has been read in advance, becomes equal to or less than a half thereof or a period during which the total number of channels 11*p* driven that are mapped to the ranks before and after output voltage is changed is the smallest.

In the third embodiment, when the output voltage value of a power circuit (a specific power source) that is mapped to the rank n is changed from the Vp (the first voltage value) to the Va (the second voltage value), the number of channels 11*p* of the power circuit that is mapped to the rank n is compared to the threshold value T3 (a predefined number). When the number of channels 11*p* is equal to or more than the threshold value T3, the ΔV (the calculation voltage value) that is smaller than the absolute value of the difference between the Vp and the Va is determined. The ΔV is calculated, for example, by a relation (the absolute value of the difference between the Va and the Vp)/(the number of channels D/T3). When the Va is larger than the Vp and when printing timing (the first timing) has arrived, the ΔV is added to the Vp. When the Va is smaller than the Vp and when the printing timing has arrived, the ΔV is subtracted from the Va. Then, when the next printing timing (the second timing) has arrived, the ΔV is added to or subtracted from the Vp. Since the ΔV is smaller than the absolute value of the difference, the output voltage of the power circuit stabilizes in a short time after addition or subtraction of the ΔV.

When the number of channels D is less than the threshold value T3, the Vp is changed to the Va. In other words, the absolute value of the difference between the Vp and the Va is added to or subtracted from the Vp. When the number of channels D is less than the threshold value T3, the difference between the Vp and the Va is small. Thus, the output voltage of the power circuit stabilizes in a short time after the Vp is directly changed to the Va.

The parts or components in the third embodiment that are the same as or equivalent to those of the first or second embodiment, are designated by the same reference numerals, and any explanation therefor will be omitted as appropriate.

Fourth Embodiment

Figure 12:
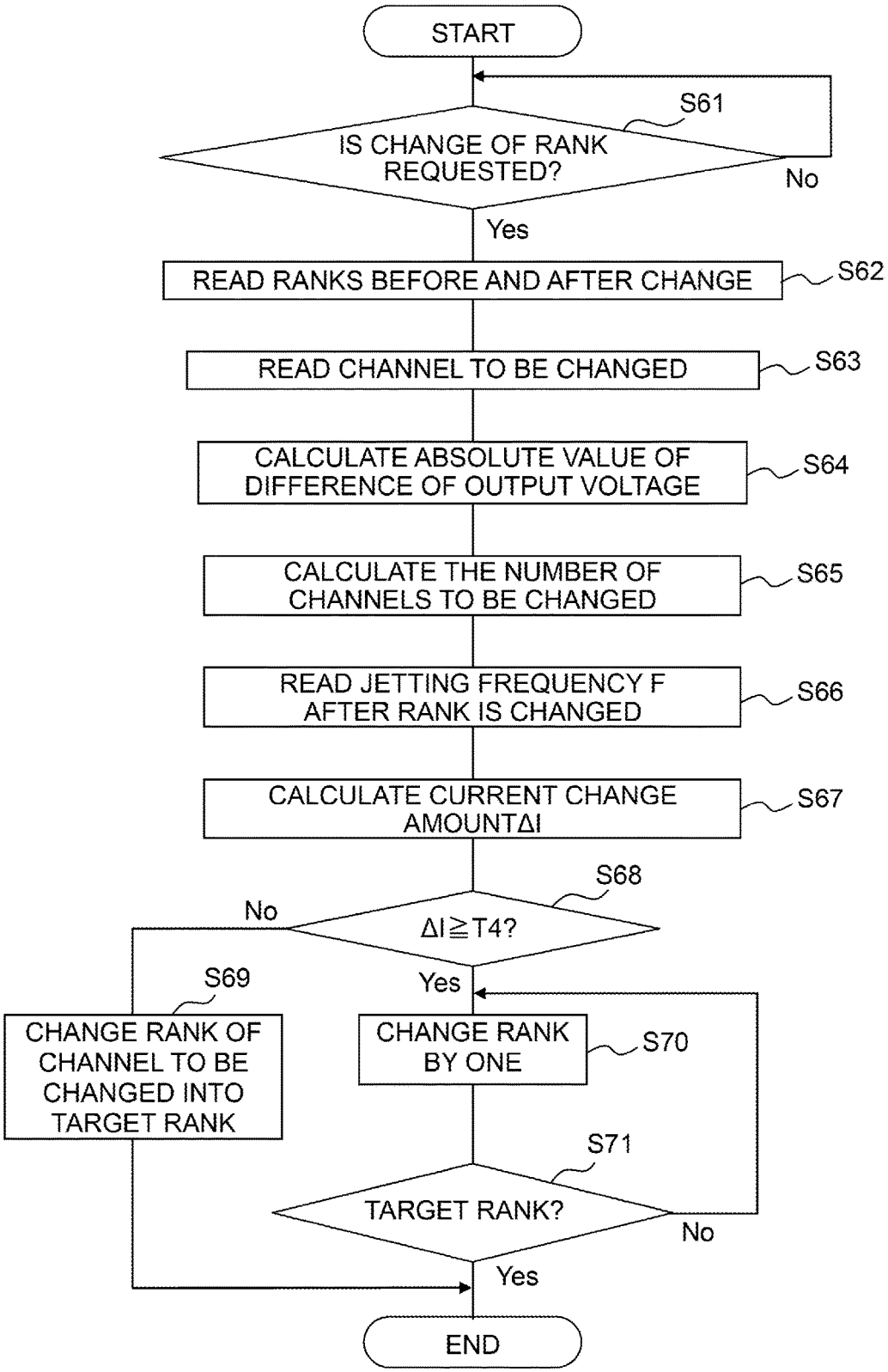
FIG. 12 is a flowchart illustrating output-voltage change processing according to a fourth embodiment.
Figure 13:
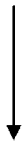
FIG. 13 is an illustrative view of a first mode.

A printing apparatus according to a fourth embodiment of the present teaching is explained with reference to FIGS. 12 to 14.

The FPGA 72*a* determines whether multiple channels 11*p* mapped to a predefined rank are requested to change the rank (step S61). When the change of the rank is not requested (step S61: NO), the FPGA 72*a* repeats the processing of the step S61.

When the change of the rank is requested (step S61: YES), the FPGA 72*a* reads the ranks before and after change (step S62). For example, the rank 2 is read as the rank before change and the rank 4 is read as the rank after change (see FIGS. 13 and 14). The FPGA 72*a* reads the channel 11*p* to be changed (step S63). For example, the FPGA 72*a* accesses the memory 75 to refer to the nozzle addresses and reads the channel 11*p* to be changed that is mapped to the rank 2.

The FPGA 72*a* calculates an absolute value of a difference between the output voltage mapped to the rank after change and the output voltage mapped to the rank before change (step S64). For example, the FPGA 72*a* calculates the absolute value of the difference between the output voltage mapped to the rank 4 and the output voltage mapped to the rank 2 (see FIGS. 13 and 14). Then, the FPGA 72*a* calculates the number of channels 11*p* to be changed based on printing data sent from the external apparatus 9 (step S65) and reads the jetting frequency F of the rank after change (step S66). The FPGA 72*a* calculates a current change amount ΔI (ΔI≥0) based on the absolute value of the difference between the output voltages calculated, the number of channels 11*p* to be changed that has been calculated, and the jetting frequency F (step S67). The ΔI is obtained by a formula or relation in proportion to the absolute value of the difference between the output voltages, the number of channels 11*p*, the jetting frequency F, and the like.

The FPGA 72*a* determines whether the current change amount ΔI is equal to or more than the threshold value T4 (step S68). The threshold value T4 is stored in the memory 75 in advance. When the current change amount ΔI is less than the threshold value T4 (step S68: NO), the FPGA 72*a* executes a first mode. In the first mode, the FPGA 72*a* changes the rank of the channel 11*p* to be changed, into a target rank (step S69). For example, 300 channels 11*p* mapped to the rank 2 are changed to have the rank 4 at once (see FIG. 13).

When the current change amount ΔI is equal to or more than the threshold value T4 (step S68: YES), the FPGA 72*a* executes a second mode to change the rank of the channel 11*p* to be changed, by one (step S70). For example, as depicted in FIG. 14, 800 channels 11*p* mapped to the rank 2 are changed to have the rank 3 before being changed to have the rank 4 (see the table before change and the table after change 1 in FIG. 14).

The FPGA 72*a* determines whether the rank after change is the target rank (step S71). When the rank after change is the target rank (step S71: YES), the FPGA 72*a* ends the processing. When the rank after change is not the target rank (step S71: NO), the FPGA 72*a* makes the processing return to the step S70 and changes the rank of the channel 11*p* to be changed, by one. For example, as depicted in FIG. 14, the channel 11*p*, of which rank was changed from the tank 2 to the rank 3 in the step S70, is changed to have the rank 4 (see the table after change 1 and the table after change 2 in FIG. 14).

The case in which the output voltage of the power circuit is increased (e.g., the case in which the rank is changed from the rank 2 to the rank 4) is explained in the fourth embodiment. The fourth embodiment, however, can be applied similarly to a case in which the output voltage of the power circuit is decreased (e.g., a case in which the rank is changed from the rank 4 to the rank 2).

As depicted in FIG. 9, the FPGA 72*a* may change the rank during a period during which the number of channels 11*p* driven that are mapped to the rank before change, which has been read in advance, becomes equal to or less than a half thereof or a period during which the total number of channels 11*p* driven that are mapped to the ranks before and after change is the smallest.

In the fourth embodiment, for example, when a channel group connected to the power circuit mapped to the rank 2 is connected to the power circuit mapped to the rank 4, the first mode or the second mode is executed. In the first mode, the channel group is connected to the power circuit mapped to the rank 4. In the second mode, the channel group is firstly connected to the power circuit mapped to the rank 3 and then connected to the power circuit mapped to the rank 4. The output voltage value of the power circuit mapped to the rank 3 is a value between the output voltage value of the power circuit mapped to the rank 2 and the output voltage value of the power circuit mapped to the rank 4. The first mode causes the channel group to be connected directly to the power circuit mapped to the rank 4. The second mode gradually changes the voltage to be applied to the channel group, and the output voltage of the power circuit stabilizes in a short time.

Further, for example, the current change amount ΔI of the channel group to be changed that is mapped to the rank 2 is calculated based on any of the number of channels 11*p*, the jetting frequency of the channels 11*p* mapped to the ranks 2 to 4, and the difference between the output voltage value of the power circuit mapped to the rank 2 and the output voltage value of the power circuit mapped to the rank 4. When the current change amount ΔI calculated is less than the threshold value T4, the first mode is executed. When the ΔI is less than the threshold value T4, the current change amount ΔI is small. Thus, the output voltage of the power circuit stabilizes in a short time even when the channel group is connected directly to the power circuit mapped to the rank 4. When the current change amount ΔI is equal to or more than the threshold value T4, the second mode is executed. When the ΔI is equal to or more than the threshold value T4, the current change amount ΔI is large. Thus, when the channel group is connected directly to the power circuit mapped to the rank 4, the output voltage of the power circuit needs a long time for its stabilization. Thus, the output voltage of the power circuit can stabilize in a short time by gradually changing the voltage that is to be supplied to the channel group.

The parts or components in the fourth embodiment that are the same as or equivalent to those of the first to third embodiments, are designated by the same reference numerals, and any explanation therefor will be omitted as appropriate.

The embodiments disclosed above should be considered as exemplary, but not as limitary in each and every aspect. It is possible to mutually combine the technical characteristics described in the respective embodiments, and the scope of those embodiments is intended to include all changes within the scope of the appended claims and an equal scope to the scope of the appended claims.

What is claimed is:

1. A liquid jetting apparatus, comprising:

a head including nozzles and driving elements arranged to correspond to the nozzles;

a power source connected to the driving elements; and a control circuit connected to the power source, wherein the control circuit is configured to:

determine whether an output voltage value of the power source is changed from a first voltage value to a second voltage value;

based on determining that the output voltage value is changed from the first voltage value to the second voltage value, calculate an absolute value of a difference between the first voltage value and the second voltage value;

compare the absolute value of the difference and a threshold value;

based on that the absolute value of the difference is equal to or more than the threshold value, determine a calculation voltage value smaller than the absolute value of the difference;

at first timing, calculate a first calculated voltage value by adding the determined calculation voltage value to the first voltage value or subtracting the determined calculation voltage value from the first voltage value; and make the power source output an output voltage corresponding to the first calculated voltage value, at second timing after the first timing, add the determined calculation voltage value to the first calculated voltage value or subtract the determined calculation voltage value from the first calculated voltage value; and make the power source output an output voltage corresponding to the value acquired by adding the determined calculation voltage value to the first calculated voltage value or a value acquired by subtracting the determined calculation voltage value from the first calculated voltage value;

determine whether a second calculated voltage value has reached the second voltage value, the second calculated voltage value being a value acquired by adding the determined calculation voltage value to the first calculated voltage value at least once or a value acquired by subtracting the determined calculation voltage value from the first calculated voltage value at least once; and based on determining that the second calculated voltage value has reached the second voltage value, stop the addition or the subtraction of the calculation voltage value.

2. The liquid jetting apparatus according to claim 1, wherein, based on that the absolute value of the difference is equal to or more than the threshold value, the control circuit is configured to determine the calculation voltage value as the threshold value.

3. The liquid jetting apparatus according to claim 1, wherein liquid is jetted from the nozzles by inputting the output voltage to the driving elements from the power source, the control circuit is configured to, at multiple timings, determine the number of driving elements, of the driving elements, to which the output voltage is to be inputted and each of the first timing and the second timing is a timing, of the multiple timings, at which the number of driving elements to which the output voltage is to be inputted is equal to or less than a half of the number of driving elements connected to the power source.

4. The liquid jetting apparatus according to claim 1, wherein based on that the absolute value of the difference is less than the threshold value, the control circuit is configured to add the absolute value of the difference to the first voltage value at the first timing and the second timing or subtract the absolute value of the difference from the first voltage value at the first timing and the second timing.

5. The liquid jetting apparatus according to claim 4, wherein a liquid is jetted from the nozzles by inputting the output voltage to the driving elements from the power source, the control circuit is configured to, at multiple timings, determine the number of driving elements, of the driving elements, to which the output voltage is to be inputted and any one of the first timing and the second timing is a timing, of the multiple timings, at which the number of driving elements to which the output voltage is to be inputted is a smallest number.

6. The liquid jetting apparatus according to claim 1, wherein a time interval between the first timing and the second timing is a jetting period during which liquid is jetted from the nozzles by inputting the output voltage from the power source to the driving elements.

7. A liquid jetting apparatus, comprising:

a head including nozzles and driving elements arranged to correspond to the nozzles;

a power source connected to the driving elements; and a control circuit connected to the power source, wherein the control circuit is configured to:

determine whether an output voltage value of the power source is changed from a first voltage value to a second voltage value;

based on determining that the output voltage value is changed from the first voltage value to the second voltage value, compare a jetting frequency and a threshold value, the jetting frequency being an inverse number of a jetting period during which liquid is jetted from the nozzles by inputting the output voltage value to the driving elements;

based on that the jetting frequency is equal to or more than the threshold value, determine a calculation voltage value smaller than an absolute value of a difference between the first voltage value and the second voltage value;

at first timing, calculate a first calculated voltage value by adding the determined calculation voltage value to the first voltage value or subtracting the determined calculation voltage value from the first voltage value; and make the power source output an output voltage corresponding to the first calculated voltage value, at second timing after the first timing, add the determined calculation voltage value to the first calculated voltage value or subtract the determined calculation voltage value from the first calculated voltage value; and make the power source output an output voltage corresponding to the value acquired by adding the determined calculation voltage value to the first calculated voltage value or a value acquired by subtracting the determined calculation voltage value from the first calculated voltage value;

determine whether a second calculated voltage value has reached the second voltage value, the second calculated voltage value being a value acquired by adding the determined calculation voltage value to the first calculated voltage value at least once or a value acquired by subtracting the determined calculation voltage value from the first calculated voltage value at least once; and based on determining that the second calculated voltage value has reached the second voltage value, stop the addition or the subtraction of the calculation voltage value.

8. The liquid jetting apparatus according to claim 7, wherein the control circuit is configured to, at multiple timings, determine the number of driving elements, of the driving elements, to which the output voltage is to be inputted from the power source, and each of the first timing and the second timing is a timing, of the multiple timings, at which the number of driving elements to which the output voltage is to be inputted is equal to or less than a half of the number of driving elements connected to the power source.

9. The liquid jetting apparatus according to claim 7, wherein based on that the jetting frequency is less than the threshold value, the control circuit is configured to add the absolute value of the difference to the first voltage value at any of the first timing and the second timing or subtract the absolute value of the difference from the first voltage value at any of the first timing and the second timing.

10. The liquid jetting apparatus according to claim 9, wherein liquid is jetted from the nozzles by inputting the output voltage from the power source to the driving elements, the control circuit is configured to, at multiple timings, determine the number of driving elements, of the driving elements, to which the output voltage is to be inputted, and any one of the first timing and the second timing is a timing, of the multiple timings, at which the number of driving elements to which the output voltage is inputted is a smallest number.

11. A liquid jetting apparatus, comprising:

a head including nozzles and driving elements arranged to correspond to the nozzles;

power sources each of which is connected to two or more of driving elements of the driving elements; and a control circuit connected to the power sources, wherein the control circuit is configured to:

determine whether an output voltage value of a specific power source of the power sources is changed from a first voltage value to a second voltage value;

based on determining that the output voltage value of the specific power source is changed from the first voltage value to the second voltage value, compare the number of specific driving elements connected to the specific power source and a predefined number;

based on that the number of specific driving elements is equal to or more than the predefined number, determine a calculation voltage value smaller than an absolute value of a difference between the first voltage value and the second voltage value;

at first timing, calculate a first calculated voltage value by adding the determined calculation voltage value to the first voltage value or subtracting the determined calculation voltage value from the first voltage value; and make the specific power source output an output voltage corresponding to the first calculated voltage value, at second timing after the first timing, add the determined calculation voltage value to the first calculated voltage value or subtract the determined calculation voltage value from the first calculated voltage value; and make the specific power source output an output voltage corresponding to the value acquired by adding the determined calculation voltage value to the first calculated voltage value or a value acquired by subtracting the determined calculation voltage value from the first calculated voltage value;

determine whether a second calculated voltage value has reached the second voltage value, the second calculated voltage value being a value acquired by adding the determined calculation voltage value to the first calculated voltage value at least once or a value acquired by subtracting the determined calculation voltage value from the first calculated voltage value at least once; and based on determining that the second calculated voltage value has reached the second voltage value, stop the addition or the subtraction of the calculation voltage value.

12. The liquid jetting apparatus according to claim 11, wherein the control circuit is configured to divide a voltage difference which corresponds to a difference between a first driving current and a second diving current of the head, by a value acquired by dividing the number of specific driving elements by the predefined number, the first driving current corresponding to a first voltage which indicates the first voltage value, the second driving current corresponding to a second voltage which indicates the second voltage value, and the control circuit is configured to add a value acquired by the division to the first voltage with time or subtract the value acquired by the division from the first voltage with time.

13. The liquid jetting apparatus according to claim 11, wherein liquid is jetted from specific nozzles, of the nozzles, corresponding to the specific driving elements by inputting the output voltage from the specific power source to the specific driving elements, the control circuit is configured to, at multiple timings, determine the number of specific driving elements to which the output voltage is to be inputted, and each of the first timing and the second timing is a timing, of the multiple timings, at which the number of specific driving elements to which the output voltage is to be inputted is equal to or less than a half of the number of specific driving elements.

14. The liquid jetting apparatus according to claim 11, wherein based on that the number of specific driving elements is less than the predefined number, the control circuit is configured to add the absolute value of the difference to the first voltage value at any of the first timing and the second timing or subtract the absolute value of the difference from the first voltage value at any of the first timing and the second timing.

15. The liquid jetting apparatus according to claim 14, wherein liquid is jetted from specific nozzles, of the nozzles, corresponding to the specific driving elements by inputting the output voltage from the specific power source to the specific driving elements, the control circuit is configured to, at multiple timings, determine the number of specific driving elements to which the output voltage is to be inputted, and any of the first timing and the second timing is a timing, of the multiple timings, at which the number of specific driving elements to which the output voltage is to be inputted is a smallest number.

16. The liquid jetting apparatus according to claim 11, wherein a time interval between the first timing and the second timing is a jetting period during which liquid is jetted from the nozzles corresponding to the specific driving elements by inputting the output voltage from the specific power source to the specific driving elements.

17. The liquid jetting apparatus according to claim 16, wherein liquid is jetted from specific nozzles, of the nozzles, corresponding to the specific driving elements by inputting the output voltage from the specific power source to the specific driving elements, the control circuit is configured to, at multiple timings, determine the number of specific driving elements to which the output voltage is to be inputted, and any of the first timing and the second timing is a timing, of the multiple timings, at which the number of specific driving elements to which the output voltage is to be inputted is a smallest number.

18. The liquid jetting apparatus according to claim 15, wherein a time interval between the first timing and the second timing is a jetting period during which the liquid is jetted from the nozzles corresponding to the specific driving elements by inputting the output voltage from the specific power source to the specific driving elements.

19. A liquid jetting apparatus, comprising:

a head including nozzles and driving elements arranged to correspond to the nozzles, the nozzles including a first nozzle group, a second nozzle group, and a third nozzle group, the driving elements including a first driving element group corresponding to the first nozzle group, a second driving element group corresponding to the second nozzle group, and a third driving element group corresponding to the third nozzle group;

power sources including a first power source having an output voltage value indicating a first driving voltage value, a second power source having an output voltage value indicating a second driving voltage value, and a third power source having an output voltage value indicating a third driving voltage value;

a switch connected to the driving elements and connected to the first, second, and third power sources;

a control circuit including a memory interface and connected to the power sources; and a memory connected to the control circuit through the memory interface and configured to store identifiers which indicate the driving elements and a driving voltage value to be input to the driving elements while mapping the identifiers to the driving voltage value, the driving voltage value being any of the first driving voltage value, the second driving voltage value, and the third driving voltage value, wherein the control circuit is configured to:

acquire the first driving voltage value and a first identifier mapped to the first driving voltage value, the second driving voltage value and a second identifier mapped to the second driving voltage value, and the third driving voltage value and a third identifier mapped to the third driving voltage value, from the memory through the memory interface;

based on the acquired first identifier and the acquired first driving voltage value, control the switch to connect the first power source and the first driving element group mapped to the first identifier;

based on the acquired second identifier and the acquired second driving voltage value, control the switch to connect the second power source and the second driving element group mapped to the second identifier;

based on the acquired third identifier and the acquired third driving voltage value, control the switch to connect the third power source and the third driving element group mapped to the third identifier; and determine whether a connection destination of the first driving element group is changed from the first power source to the second power source after the first, second, third driving element groups are connected to the first, second, and third power sources, respectively, wherein, based on determining that the connection destination of the first driving element group is changed from the first power source to the second power source, the control circuit is configured to execute any one of:

a first mode in which the connection destination of the first driving element group is changed, at first timing, from the first power source to the second power source; and a second mode in which the connection destination of the first driving element group is changed, at first timing, from the first power source to the third power source and the connection destination of the first driving element group is changed, at second timing after the first timing, from the third power source to the second power source, and wherein the first driving voltage value, the third driving voltage value, and the second driving voltage value become higher in that order or become lower in that order.

20. The liquid jetting apparatus according to claim 19, wherein the control circuit is configured to:

based on determining that the connection destination of the first driving element group is changed from the first power source to the second power source, calculate a change amount of a driving current of the first driving element group on the basis of any of the number of driving elements included in the first driving element group, a jetting frequency of liquid jetted from the first, second, and third nozzle groups, and a difference between the first driving voltage value and the second driving voltage value;

based on that the change amount is less than a predefined value, execute the first mode; and based on that the change amount is equal to or more than the predefined value, execute the second mode.

21. The liquid jetting apparatus according to claim 19, wherein the control circuit is configured to, at multiple timings, determine the number of driving elements, of the driving elements included in the first driving element group, to which an output voltage is to be inputted from any of the first, second, and third power sources, and each of the first timing and the second timing is a timing, of the multiple timings, at which the number of driving elements to which the output voltage is to be inputted is equal to or less than a half of the number of driving elements included in the first driving element group.

22. The liquid jetting apparatus according to claim 19, wherein the control circuit is configured to, at multiple timings, determine the number of driving elements, of the driving elements included in the first driving element group, to which an output voltage is inputted from any of the first, second, and third power sources, and any of the first timing and the second timing is a timing, of the multiple timings, at which the number of driving elements to which the output voltage is inputted is a smallest number.

23. The liquid jetting apparatus according to claim 19, wherein a time interval between the first timing and the second timing is a jetting period during which liquid is jetted from the first nozzle group by inputting the output voltage from any of the first, second, and third power sources to the first driving element group.

* * * * *